US008179409B2

(12) United States Patent
Saga

(10) Patent No.: US 8,179,409 B2
(45) Date of Patent: May 15, 2012

(54) THERMAL PRINTER

(75) Inventor: Kengo Saga, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/714,784

(22) Filed: Mar. 1, 2010

(65) Prior Publication Data

US 2010/0238254 A1 Sep. 23, 2010

(30) Foreign Application Priority Data

Mar. 19, 2009 (JP) ..... 2009-068925

(51) Int. Cl.
*B41J 2/36* (2006.01)
*B41J 2/35* (2006.01)

(52) U.S. Cl. ..... 347/211; 347/218; 347/190; 347/192

(58) Field of Classification Search ..... 347/188, 347/190, 192, 171, 215, 218, 211; 400/120.09, 400/120.1, 120.12, 188
See application file for complete search history.

(56) References Cited

U.S. PATENT DOCUMENTS 5,099,258 A * 3/1992 Hirayama ..... 347/188
5,144,329 A * 9/1992 Takeda et al. ..... 347/215
7,967,408 B2 * 6/2011 Saga ..... 347/14

FOREIGN PATENT DOCUMENTS

JP 05-050638 3/1993
JP 05-077469 3/1993
JP 09-262997 * 10/1997

OTHER PUBLICATIONS

Machine-generated translation of JP 05-077469, published on Mar. 1993.*
Machine-generated translation of JP 05-050638, published on Mar. 1993.*

* cited by examiner

*Primary Examiner* — Huan Tran
(74) *Attorney, Agent, or Firm* — Turocy & Watson, LLP

(57) ABSTRACT

A print-dot counting section counts a number of print dots of print data. An adjusting section adjusts to reduce, according to the number of print dots counted by the print-dot counting section, one of conveying speed of a print medium by a conveying unit and energization time of energization to heat generating elements for forming one dot on the print medium and adjusts to reduce the other when the one reaches a lower limit value in an adjustable range. The conveying unit and a thermal head are driven by using the conveying speed and the energization time adjusted in this way to perform printing on the print medium.

16 Claims, 5 Drawing Sheets

3b

| | Energization time |
|---|---|
| Average number of dots | ⋮ |

4a

40

| Priority mode | Speed/density |
|---|---|

| | Energization time control | Energization time | Conveying speed |
|---|---|---|---|
| First thermal head | ON/OFF | ... | V1/V2 |
| Second thermal head | ON/OFF | ... | |

41 42 43

THERMAL PRINTER

CROSS REFERENCE TO RELATED APPLICATION

This application is based upon and claims the benefit of priority from the prior Japanese Patent Application No. 2009-068925, filed Mar. 19, 2009, the entire contents of which are incorporated herein by reference.

TECHNICAL FIELD

The present invention relates to a thermal printer configured to control energy applied to a thermal head to perform printing on a print medium such as thermal recording paper.

BACKGROUND

A thermal printer known in the past conveys a print medium such as thermal recording paper to a contact position between a thermal head, in which heat generating elements are linearly disposed, and a platen roller arranged to be opposed to the thermal head and controls energy applied to the thermal head to, for example, cause the print medium to develop a color to thereby form a print pattern on the print medium.

When a large number of places where the thermal head should be simultaneously heated are present on one line of print data, in some cases, power consumption increases to exceed the capacity of a power supply that supplies electric power to the thermal printer. In such a case, an inconvenience occurs in that a desired print result cannot be obtained because the energy applied to the thermal head runs short and print is blurred or conveying speed of the print medium falls.

As a related art for solving such a problem, a thermal printer disclosed in JP-A-5-77469 is known. The thermal printer is configured to appropriately adjust, in order to perform printing while keeping power consumption within a limit of a power capacity, energy applied to a thermal head and conveying speed of a conveying unit configured to convey a print medium.

However, depending on print data, power shortage still occurs even if the energy applied to the thermal head and the conveying speed of the conveying unit are adjusted as in the thermal printer disclosed in JP-A-5-77469.

When a large number of sheets are printed, extremely long time is required until completion of the printing if conveying speed of a print medium is set low.

Among thermal printers, some thermal printers include a thermal head configured to perform printing on the rear side of a print medium in addition to a thermal head configured to perform printing on the front side of the print medium and simultaneously perform printing on both the front side and the rear side of the print medium. When the printing is simultaneously performed on both the sides of the print medium, a large amount of power is necessary compared with printing performed only on one side of the print medium. Therefore, the problem of the power shortage is more conspicuous.

SUMMARY

The present invention is devised in view of the circumstances and it is an object of the present invention to provide a thermal printer that can reduce power consumption in print processing and obtain a stable and satisfactory print result in a form desired by a user according to a state of use.

A thermal printer according to an aspect of the present invention includes: a conveying unit configured to convey a print medium; a thermal head configured to have linearly-disposed heat generating elements and control energization to the heat generating elements on the basis of print data to perform printing on the print medium conveyed by the conveying unit; a print-dot counting section configured to count the number of print dots of the print data; an adjusting section configured to adjust to reduce, according to the number of print dots counted by the print-dot counting section, one of conveying speed of the print medium by the conveying unit and energization time of energization to the heat generating elements for forming one dot on the print medium and adjust to reduce the other when the one reaches a lower limit value in an adjustable range; and a print control section configured to drive the conveying unit and the thermal head with the conveying speed and the energization time adjusted by the adjusting section and perform printing on the print medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

A first embodiment of the present invention is explained below with reference to the accompanying drawings.

Figure 1:
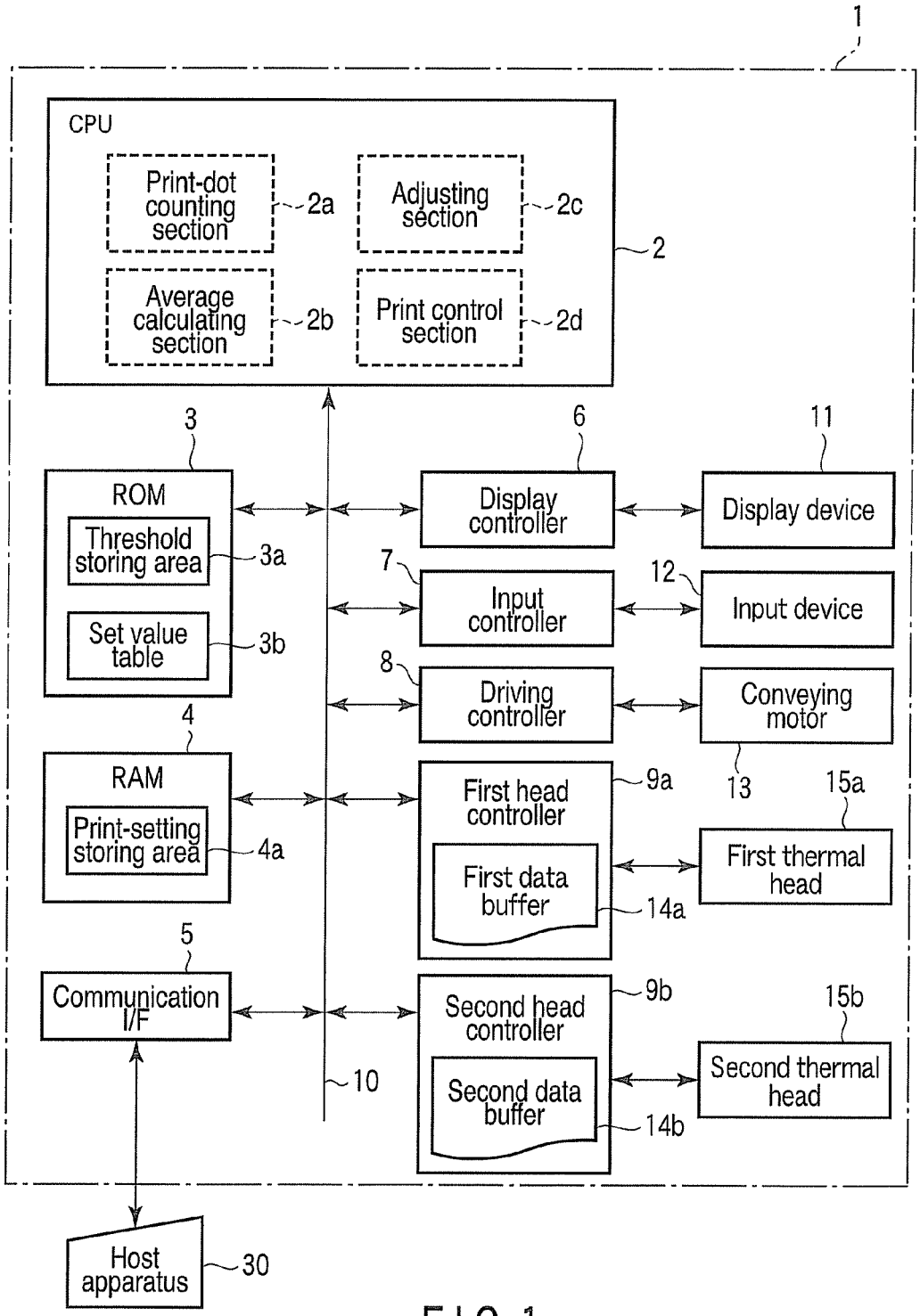
FIG. 1 is a block diagram of the configuration of a main part of a thermal printer according to a first embodiment of the present invention.
Figures 2, 3, 4:
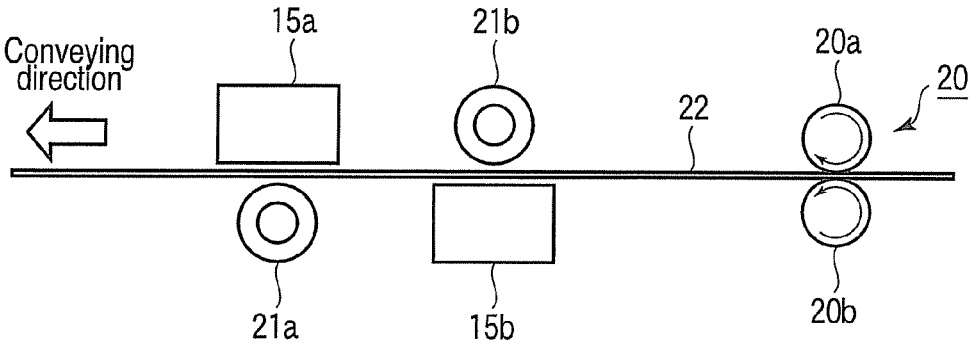
FIG. 2 is a schematic diagram of a printing mechanism of the thermal printer according to the embodiment.
FIG. 3 is a schematic diagram of a data structure of a set value table in the embodiment.
FIG. 4 is a schematic diagram of a data structure of a print setting area in the embodiment.

FIG. 1 is a block diagram of the configuration of a main part of a thermal printer 1 according to the first embodiment. FIG. 2 is a schematic diagram of a printing mechanism of the thermal printer 1.

The thermal printer 1 includes a CPU (Central Processing Unit) 2 functioning as a core of control. A ROM (Read Only Memory) 3, a RAM (Random Access Memory) 4, a communication interface (I/F) 5, a display controller 6, an input controller 7, a driving controller 8, a first head controller 9*a* including a first data buffer 14*a*, a second head controller 9*b* including a second data buffer 14*b*, and the like are connected to the CPU 2 via a bus line 10 such as an address bus and a data bus.

A host apparatus 30 such as a personal computer is connected to the communication interface 5, a display device 11 is connected to the display controller 6, an input device 12 is connected to the input controller 7, a conveying motor (a conveying unit) 13 is connected to the driving controller 8, a first thermal head 15*a* is connected to the first head controller 9*a*, and a second thermal head 15*b* is connected to the second head controller 9*b*.

The ROM 3 has a threshold storing area (a threshold storing section) 3*a* and a set value table 3*b*. Predetermined thresholds α, β, and γ used in processing explained later are stored in the threshold storing area 3*a*. A set value of energization time explained with reference to FIG. 3 later is stored in the set value table 3*b*.

The RAM 4 forms a storage area for work such as a print setting storing area 4*a* according to a situation of processing by the thermal printer 1. Print setting explained with reference to FIG. 4 later is stored in the print setting storing area 4*a*.

The communication interface 5 controls communication with the host apparatus 30. When the communication interface 5 receives a command from the host apparatus 30, the communication interface 5 notifies the CPU 2 of the command. When the communication interface 5 receives print data for the front side of a print medium and print data for the rear side of the print medium from the host apparatus 30, the communication interface 5 outputs the received print data for the front side to the first data buffer 14*a* and outputs the received print data for the rear side to the second data buffer 14*b*.

The display device 11 includes a liquid crystal display and a LED. The display controller 6 controls the display device 11 to display various kinds of information.

The input device 12 includes operation keys and a touch panel provided on a display surface of the display device 11. The input controller 7 detects a signal output from the input device 12 according to operation by a user and notifies the CPU 2 of the signal.

The conveying motor 13 rotates the conveying roller 20 to be capable of normally and reversely rotating. The conveying roller 20 includes a driving roller 20*a* and a driven roller 20*b* and conveys a print medium 22, on both the front and rear sides of which heat sensitive layers are formed, in a conveying direction indicated by an arrow in FIG. 2. The driving controller 8 controls the rotation of the conveying motor 13.

The first thermal head 15*a* is set to be in contact with, via the print medium 22, a platen roller 21*a* set further on a downstream side in the conveying direction than the conveying roller 20 and on the side of the rear side of the print medium 22. The second thermal head 15*b* is set in contact with, via the print medium 22, a platen roller 21*b* set further on the downstream side in the conveying direction than the conveying roller 20 and on the side of the front side of the print medium 22.

The first thermal head 15*a* and the second thermal head 15*b* respectively include a large number of heat generating elements linearly disposed near contact positions with the first platen roller 21*a* and the second platen roller 21*b*. The first head controller 9*a* controls, on the basis of conveying speed of conveyance of the print medium 22 by the conveying motor 13 and the print data stored in the first data buffer 14*a*, energization to the heat generating elements included in the first thermal head 15*a*. The second head controller 9*b* controls, on the basis of the conveying speed of conveyance of the print medium 22 by the conveying motor 13 and the print data stored in the second data buffer 14*b*, energization to the heat generating elements included in the second thermal head 15*b*.

When the heat generating elements of the first thermal head 15*a* generate heat, sections corresponding to places of the heat generation on the front side of the print medium 22 develop a color to form a print pattern. When the heat generating elements of the second thermal head 15*b* generate heat, sections corresponding to places of the heat generation on the rear side of the print medium 22 develop a color to form a print pattern. Heat generation amounts of the heat generating elements increase according to an increase in energization time.

The CPU 2 includes control sections configured to realize control characteristic to this embodiment, i.e., a print-dot counting section 2*a*, an average calculating section 2*b*, an adjusting section 2*c*, and a print control section 2*d*.

The print-dot counting section 2*a* counts the number of print dots of print data dot-expanded in the first data buffer 14*a* and the second data buffer 14*b*.

The average calculating section 2*b* calculates, on the basis of the number of print dots counted by the print-dot counting section 2*a*, an average number of print dots per one line included in the print data.

The adjusting section 2*c* adjusts to reduce, according to the average number of print dots calculated by the average calculating section 2*b*, one of conveying speed V (V>0) of conveyance of a print medium by the conveying motor 13 and energization time T (T>0) of energization to the heat generating elements for forming one dot on the print medium. The adjusting section 2*c* adjusts to reduce the other when the one reaches a lower limit value in an adjustable range. In this embodiment, the adjusting section 2*c* determines the energization time T, which is a target value of the adjustment, using the set value table 3*b*. The adjusting section 2*c* adjusts the conveying speed V in two stages, i.e., speed V1 (0<V1) and speed V2 (0<V2<V1) lower than the speed V1.

The print control section 2*d* drives the conveying motor 13 such that the print medium 22 is conveyed at the conveying speed V adjusted by the adjusting section 2*c*. The print control section 2*d* drives the first thermal head 15*a* and the second thermal head 15*b* such that the heat generating elements are energized in the energization time T adjusted by the adjusting section 2*c*. In this way, the print control section 2*d* performs printing on the print medium 22.

FIG. 3 is a schematic diagram of an example of a data structure of the set value table 3*b*. In the set value table 3*b*, an average number of print dots $D_{ave}$ per one line is associated with the energization time T that should be set in printing print data having each average number of print dots $D_{ave}$. The average number of print dots $D_{ave}$ per one line is a value obtained by adding up an average number of print dots $D_{ave}'$ ($=D_1/L_1$) of print data on the front side, which is calculated by dividing a total number of dots $D_1$ of the print data on the front side by the number of lines $L_1$ of the print data on the front side, and an average number of print dots $D_{ave2}$ ($=D_2/L_2$) of print data on the rear side, which is calculated by dividing a total number of dots $D_2$ of the print data on the rear side by the number of lines $L_2$ of the print data on the rear side ($D_{ave}=D_{ave1}+D_{ave2}$). The energization time T is experimentally or logically determined to decrease as the average number of print dots $D_{ave}$ increases.

When the energization time T of energization to the first thermal head 15*a* or the second thermal head 15*b* is reduced, power consumption necessary during printing decreases. However, since the decrease in the power consumption does not involve heat generation for causing the heat sensitive layers of the print medium 22 to sufficiently develop a color, print density decreases. When the conveying speed V is adjusted to the speed V2, the power consumption necessary during printing decreases. However, time until the print medium 22 is discharged is extended. In this way, when it is attempted to adjust the energization time T and the conveying speed V to reduce the power consumption during printing, certain disadvantages are caused. Therefore, the thermal printer 1 includes a function for the user to realize desired print setting according to an individual and specific state of use. The function is realized by using the print-setting storing area 4*a*.

FIG. 4 is a schematic diagram of an example of a data structure of the print-setting storing area 4*a*. In the print-setting storing area 4*a*, a priority-mode setting area (a priority designating section) 40, a control-permission-or-rejection setting area (an adjustment-permission-or-rejection setting section) 41, an energization-time setting area 42, and a conveying-speed setting area 43 are provided.

In the priority-mode setting area 40, one of a speed priority mode for giving priority to printing speed and a density priority mode for giving priority to print density of a print result selected by the user (speed or density) is set. In the control-permission-or-rejection setting area 41, distinction concerning whether the energization time T is controlled (ON or OFF) is set for the first thermal head 15*a* and the second thermal head 15*b*. In the energization-time setting area 42, the energization time T that should be used during printing is set for each of the first thermal head 15*a* and the second thermal head 15*b*. In the conveying-speed setting area 43, the conveying speed V (V1 or V2) of conveyance of the print medium 22 by the conveying motor 13 is set. The conveying speed V1 is set as default in the conveying-speed setting area 43. The setting of the priority-mode setting area 40 and the control-permission-or-rejection setting area 41 can be changed by a command from the host apparatus 30, the operation of the input device 12, or adjustment processing explained with reference to FIG. 5 later.

The thresholds α, β, and γ stored in the threshold storing area 3*a* are explained below. The threshold α is the number of dots per one line for distinguishing whether power consumption exceeds a power supply capacity when the energization time T and the conveying speed V are set to default. The threshold β is the number of dots per one line for distinguishing whether power consumption exceeds the power supply capacity if the speed priority mode is set in the priority-mode setting area 40 of the print-setting storing area 4*a* and the energization time T is set to the lower limit value in the adjustable range. The threshold γ is the number of dots per one line for distinguishing whether power consumption exceeds the power supply capacity if the density-priority mode is set in the priority-mode setting area 40 of the print-setting storing area 4*a* and the conveying speed V is set to the lower limit value in the adjustable range (i.e., the conveying speed V2). Therefore, at least the threshold α is set to a value equal to or smaller than the thresholds β and γ ($\alpha \leqq \beta, \gamma$).

The operation of the thermal printer 1 is explained below.

When a print command and print data on the front side and the rear side are received from the host apparatus 30 via the communication interface 5, the print data on the front side is dot-expanded in the first data buffer 14*a* and the print data on the rear side is dot-expanded in the second data buffer 14*b*.

Figure 5:
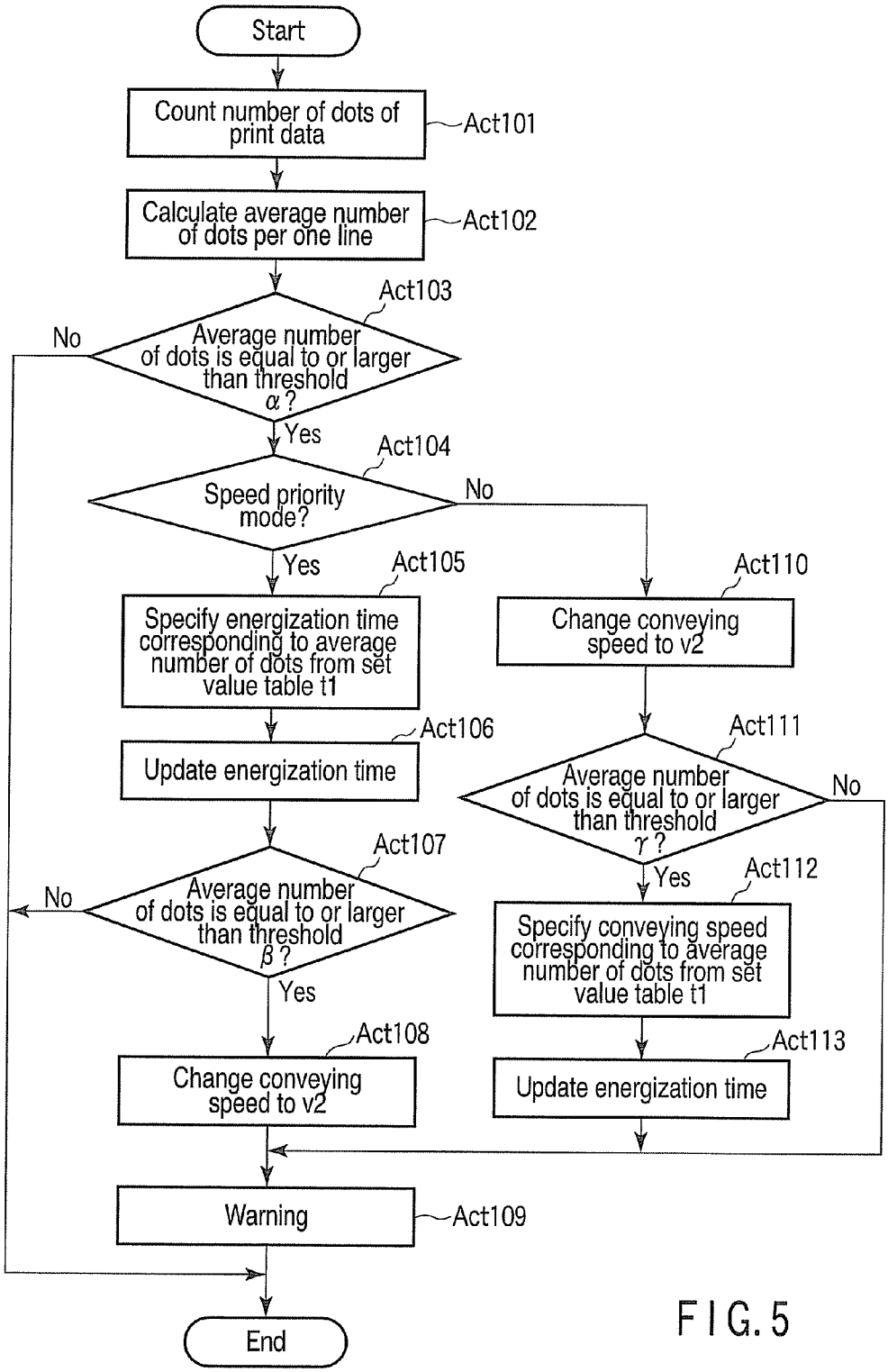
FIG. 5 is a flowchart for explaining print setting adjustment processing executed by a CPU in the embodiment.

FIG. 5 is a flowchart for explaining print setting adjustment processing executed by the CPU 2 according to the reception of the print command. This processing is realized by the print-dot counting section 2*a*, the average calculating section 2*b*, the adjusting section 2*c*, and the print control section 2*d*.

First, the CPU 2 counts the numbers of print dots of the print data expanded in the first data buffer 14*a* and the print data expanded in the second data buffer 14*b* (Act 101).

Subsequently, the CPU 2 calculates the average number of print dots $D_{ave}$ per one line on the basis of a counting result of the number of print dots (Act 102). As explained above, the value obtained by adding up the average number of print dots $D_{ave1}$ ($=D_1/L_1$) of the print data on the front side, which is calculated by dividing the total number of dots $D_1$ of the print data on the front side by the number of lines $L_1$ of the print data on the front side, and the average number of print dots $D_{ave2}$ ($=D_2/L_2$) of print data on the rear side, which is calculated by dividing the total number of dots $D_2$ of the print data on the rear side by the number of lines $L_2$ of the print data on the rear side is set as the average number of print dots $D_{ave}$ of the entire print data ($D_{ave}=D_{ave1}+D_{ave2}$).

Subsequently, the CPU 2 determines whether the calculated average number of print dots $D_{ave}$ is equal to or larger than the threshold a stored in the threshold storing area 3*a* ($D_{ave} \geqq \alpha$) (Act 103). If the average number of print dots $D_{ave}$ is smaller than the threshold α ($D_{ave} < \alpha$) (No in Act 103), power consumption in the printing does not exceed the power supply capacity. Therefore, since it is unnecessary to adjust the energization time T and the conveying speed V, the CPU 2 ends the print setting adjustment processing and starts printing.

On the other hand, if the average number of print dots $D_{ave}$ is equal to or larger than the threshold α ($D_{ave} \geqq \alpha$) (Yes in Act 103), the CPU 2 refers to the priority-mode setting area 40 of the print-setting storing area 4*a* and determines whether the speed priority mode is set in the priority-mode setting area 40 (Act 104).

If the speed priority mode is set (Yes in Act 104), the CPU 2 refers to the set value table 3*b* and specifies the energization time T associated with the average number of print dots $D_{ave}$ calculated in the processing in Act 102 (Act 105).

Thereafter, the CPU 2 refers to the control-permission-or-rejection setting area 41 and specifies whether energization time control for the first thermal head 15*a* and the second thermal head 15*b* is set to ON. If the energization time control for the first thermal head 15*a* is set to ON, the CPU 2 updates the energization time T set in the energization-time setting area 42 of the first thermal head 15*a* by the energization time T specified in the processing in Act 105 and, if the energization time control for the second thermal head 15*b* is set to ON, the CPU 2 updates the energization time T set in the energization-time setting area 42 of the second thermal head 15*b* by the energization time T specified in the processing in Act 105 (Act 106). In this way, the energization time T for the first thermal head 15*a* and the second thermal head 15*b* is adjusted to be reduced.

The CPU 2 determines whether the average number of print dots $D_{ave}$ calculated in the processing in Act 102 is equal to or larger than the threshold β stored in the threshold storing area 3*a* ($D_{ave} \geqq \beta$) (Act 107).

If the average number of print dots $D_{ave}$ is smaller than the threshold β ($D_{ave} < \beta$) (No in Act 107), power consumption in the printing is already reduced to be within a range of the power supply capacity by the change of the energization time T. In this case, the CPU 2 outputs, to the display device 11 and the host apparatus 30, a warning indicating that the energization time T is changed and ends the print setting adjustment processing. The CPU 2 starts printing by the energization time T and the conveying speed V set in the print-setting storing area 4*a*.

On the other hand, if the average number of print dots $D_{ave}$ is equal to or larger than the threshold β ($D_{ave} \geqq \beta$) (Yes in Act 107), the power consumption still exceeds the power supply capacity even if the energization time reaches the lower limit value in the adjustable range. Therefore, the CPU 2 changes the conveying speed V set in the conveying-speed setting area 43 to the speed V2 (Act 108). Thereafter, the CPU 2 outputs, to the display device 11 and the host apparatus 30, a warning indicating that the energization time T and the conveying speed V are changed (Act 109) and ends the print setting adjustment processing. The CPU 2 starts printing by the energization time T and the conveying speed V set in the print setting storing area 4*a*.

If the density priority mode is set in the priority-mode setting area 40 of the print-setting storing area 4*a* in the processing in Act 104 (No in Act 104), the CPU 2 changes the conveying speed V set in the conveying-speed setting area 43 to the speed V2 (Act 110). In this way, the conveying speed V is adjusted to be reduced.

Thereafter, the CPU 2 determines whether the average number of print dots $D_{ave}$ calculated in the processing in Act 102 is equal to or larger than the threshold γ stored in the threshold storing area 3*a* ($D_{ave} \geqq \gamma$) (Act 111).

If the average number of print dots $D_{ave}$ is smaller than the threshold γ ($D<\gamma$) (No in Act 111), the power consumption in the print processing is already reduced to be within the range of the power supply capacity by the change of the conveying speed V. In this case, the CPU 2 outputs, to the display device 11 and the host apparatus 30, a warning indicating that the conveying speed V is changed (Act 109) and ends the print adjustment setting processing. The CPU 2 starts printing by the energization time T and the conveying speed V set in the print-setting storing area 4*a*.

On the other hand, if the average number of print dots $D_{ave}$ is equal to or larger than the threshold γ ($D_{ave} \geqq \gamma$) (Yes in Act 111), the power consumption still exceeds the power supply capacity even if the conveying speed V reaches the lower limit value in the adjustable range. Therefore, it is necessary to adjust to reduce the energization time T. The CPU 2 refers to the set value table 3*b* and specifies the energization time T associated with the average number of print dots $D_{ave}$ calculated in the processing in Act 102 (Act 112). Thereafter, the CPU 2 refers to the control-permission-or-rejection setting area 41 and determines whether the energization time control for the first thermal head 15*a* and the second thermal head 15*b* is set to ON. If the energization time control for the first thermal head 15*a* is set to ON, the CPU 2 updates the energization time T set in the energization-time setting area 42 of the first thermal head 15*a* by the energization time T specified by the processing in Act 112 and, if the energization time control for the second thermal head 15*b* is set to ON, the CPU 2 updates the energization time T set in the energization-time setting area 42 of the second thermal head 15*b* by the energization time T specified in the processing in Act 112 (Act 113). Thereafter, the CPU 2 outputs, to the display device 11 and the host apparatus 30, a warning indicating that the energization time T and the conveying speed V are changed (Act 109) and ends the print setting adjustment processing. The CPU 2 starts printing by the energization time T and the conveying speed V set in the print-setting storing area 4*a*.

As explained above, the thermal printer 1 according to this embodiment counts the number of print dots of print data and adjusts to reduce, according to a result of the counting, one of the conveying speed V of the print medium 22 and the energization time T of energization to the heat generating elements. When the power consumption still exceeds the power supply capacity even if the one reaches the lower limit value in the adjustable range, the CPU 2 adjusts to reduce the other. If both of the energization time T and the conveying speed V are adjusted in this way, an adjustable range of the power consumption is enlarged compared with that in adjusting only the conveying speed V. Therefore, it is possible to obtain a stable and satisfactory print result.

If the speed priority mode is set in the print-setting storing area 4*a*, the energization time T and the conveying speed V are adjusted to maintain printing speed as much as possible. If the density priority mode is set in the print-setting storing area 4*a*, the energization time T and the conveying speed V are adjusted to maintain print density as much as possible. If this function is used, the user can give priority to desired one of an image quality of a print result and time required until completion of printing according to a state of use of the thermal printer 1.

Only when the average number of print dots $D_{ave}$ is equal to or larger than the threshold α, the energization time T and the conveying speed V are adjusted. Since the threshold α is the number of dots per one line for distinguishing whether power consumption exceeds the power supply capacity, the adjustment processing for the energization time T and the conveying speed V is performed only when power consumption during printing exceeds the power supply capacity. Therefore, the adjustment processing for the energization time T and the conveying speed V is performed only when necessary. It is possible to eliminate useless processing and reduce printing time.

Rather than the energization time T and the conveying speed V being adjusted for each print line, printing is performed with the same energization time T and the same conveying speed V in entire print data for one sheet. Therefore, fluctuation in print density does not occur in a print result of one sheet.

A second embodiment of the present invention is explained below with reference to the accompanying drawings.

The thermal printer 1 according to this embodiment is different from that according to the first embodiment in that the thermal printer 1 divides print data into a predetermined number of areas and changes the energization time T and the conveying speed V on the basis of average numbers of print dots in the respective areas. The same reference numerals and signs are given to the same components and the explanation thereof is omitted.

Figure 6:
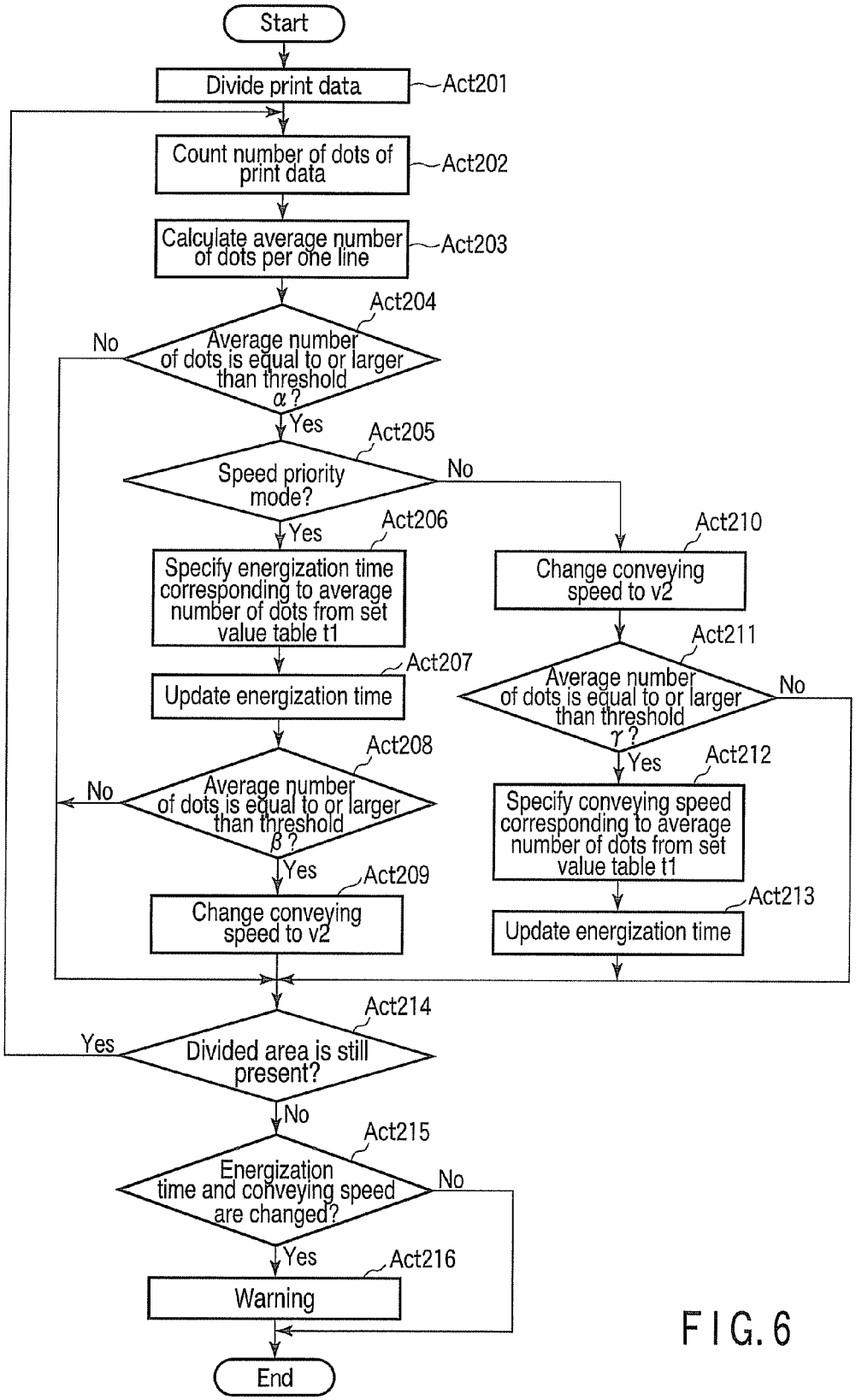
FIG. 6 is a flowchart for explaining print processing executed by a CPU in a second embodiment of the present invention.

FIG. 6 is a flowchart for explaining processing executed by the CPU 2 in print setting adjustment processing in this embodiment. This processing is realized by the print-dot counting section 2*a*, the average-value calculating section 2*b*, the adjusting section 2*c*, and the print control section 2*d*.

First, the CPU 2 divides both of print data expanded in the first data buffer 14*a* and print data expanded in the second data buffer 14*b* into a predetermined number of areas (Act 201).

Figure 7:
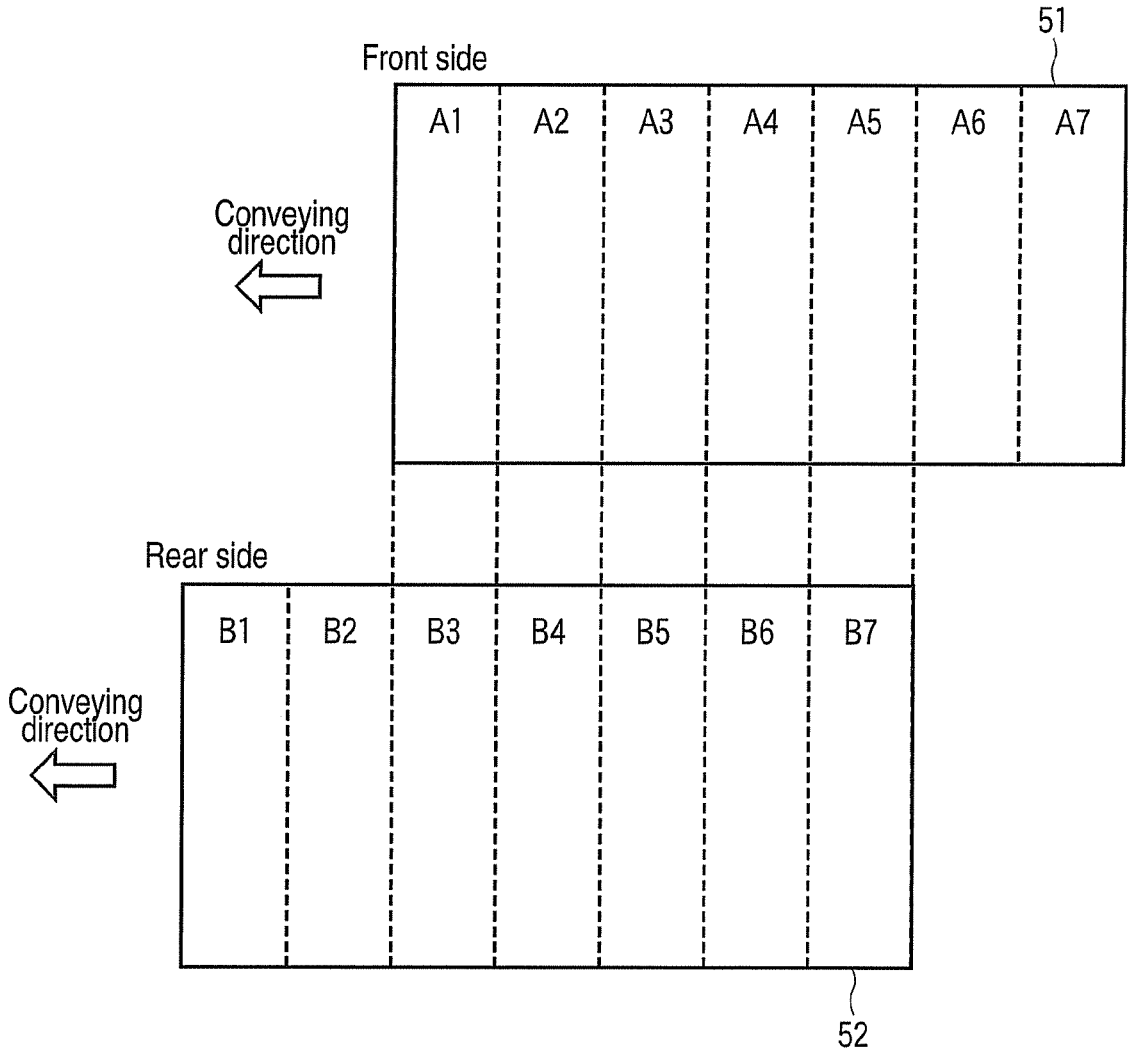
FIG. 7 is a schematic diagram for explaining division of print data in the embodiment.

The division of the print data is explained with reference to FIG. 7. Reference numeral 51 denotes print data on the front side expanded in the first data buffer 14*a* and 52 denotes print data on the rear side expanded in the second data buffer 14*b*. The print data 51 is divided into seven areas A1 to A7 in order from a downstream side in a conveying direction in printing. The print data 52 is divided into seven areas B1 to B7 in order from the downstream side in the conveying direction in printing. The area A1 and the area B3, the area A2 and the area B4, the area A3 and the area B5, the area A4 and the area 56, and the area A5 and the area B7 are respectively areas simultaneously printed by the first thermal head 15*a* and the second thermal head 15*b*.

After dividing the print data on the front side and the rear side into the predetermined number of areas, first, the CPU 2 counts the number of print dots in an area to be printed first (Act 202).

Subsequently, the CPU 2 calculates the average number of print dots $D_{ave}$ per one line on the basis of a counting result of the number of print dots (Act 203). In an example shown in FIG. 7, in the processing in Acts 201 and 202, the number of print dots in the area B1 is counted and an average number of print dots per one line is calculated on the basis of a result of the counting.

The CPU 2 determines whether the calculated average number of print dots $D_{ave}$ is equal to or larger than the threshold α stored in the threshold storing area 3*a* ($D_{ave} \geqq \alpha$) (Act 204).

If the average number of print dots is equal to or larger than the threshold α ($D_{ave} \geqq \alpha$) (Yes in Act 204), the CPU 2 refers to the print-setting storing area 4*a* and determines whether the speed-priority mode is set in the priority-mode setting area 40 (Act 205).

If the speed priority mode is set (Yes in Act 205), the CPU 2 refers to the set value table 3*b* and specifies the energization time T associated with the average number of print dots $D_{ave}$ calculated in the processing in Act 203 (Act 206).

Thereafter, the CPU 2 refers to the control-permission-or-rejection setting area 41 and specifies whether the energization time control for the first thermal head 15*a* and the second thermal head 15*b* is set to ON. If the energization time control for the first thermal head 15*a* is set to ON, the CPU 2 updates the energization time T set in the energization-time setting area 42 of the first thermal head 15*a* by the energization time T specified in the processing in Act 206 and, if the energization time control for the second thermal head 15*b* is set to ON, the CPU 2 updates the energization time T set in the energization-time setting area 42 of the second thermal head 15*b* by the energization time T specified in the processing in Act 206 (Act 207). In this way, the energization time T for the first thermal head 15*a* and the second thermal head 15*b* is adjusted to be reduced.

The CPU 2 determines whether the average number of print dots $D_{ave}$ calculated in the processing in Act 202 is equal to or larger than the threshold β stored in the threshold storing area 3*a* ($D_{ave} \geqq \beta$) (Act 208).

If the average number of print dots $D_{ave}$ is equal to or larger than the threshold β ($D_{ave} \geqq \beta$) (Yes in Act 208), power consumption still exceeds the power supply capacity even if the energization time T is changed. Therefore, the CPU 2 changes the conveying speed V set in the conveying-speed setting area 43 to the speed V2 (Act 209).

On the other hand, if the density priority mode is set in the priority-mode setting area 40 of the print-setting storing area 4*a* in the processing in Act 205 (No in Act 205), the CPU 2 changes the conveying speed V set in the conveying-speed setting area 43 to the speed V2 (Act 210). In this way, the conveying speed V is adjusted to be reduced.

Thereafter, the CPU 2 determines whether the average number of print dots $D_{ave}$ calculated in the processing in Act 203 is equal to or larger than the threshold γ stored in the threshold storing area 3*a* ($D_{ave} \geqq \gamma$) (Act 211).

If the average number of print dots $D_{ave}$ is equal to or larger than the threshold γ ($D_{ave} \geqq \gamma$) (Yes in Act 211), the CPU 2 refers to the set value table 3*b* and specifies the energization time T associated with the average number of print dots $D_{ave}$ calculated in the processing in Act 203 (Act 212). Thereafter, the CPU 2 refers to the control-permission-or-rejection setting area 41 and specifies whether the energization time control for the first thermal head 15*a* and the second thermal head 15*b* is set to ON. If the energization time control for the first thermal head 15*a* is set to ON, the CPU 2 updates the energization time T set in the energization-time setting area 42 of the first thermal head 15*a* by the energization time T specified in the processing in Act 212 and, if the energization time control for the second thermal head 15*b* is set to ON, the CPU 2 updates the energization time T set in the energization-time setting area 42 of the second thermal head 15*b* by the energization time T specified in the processing in Act 212 (Act 213).

After changing the conveying speed V to the speed V2 in the processing in Act 209, if it is determined in the processing in Act 204 that the average number of print dots $D_{ave}$ is smaller than the threshold α ($D_{ave} < \alpha$) (No in Act 204), if it is determined in the processing in Act 208 that the average number of print dots $D_{ave}$ is smaller than the threshold β ($D_{ave} < \beta$) (No in Act 208), after the energization time T is updated in the processing in Act 213, or it is determined in the processing in Act 211 that the average number of print dots $D_{ave}$ is smaller than the threshold γ ($D_{ave} < \gamma$) (No in Act 211), the CPU 2 determines whether an area for which the calculation of the average number of print dots $D_{ave}$ and the like (the processing in Act 201 to Act 213) are not performed yet is present (Act 214).

After the first processing, the areas A1 to A7 and B2 to B7 are not processed yet (Yes in Act 214). Therefore, the CPU 2 returns to the processing in Act 202 and executes the series of processing (Act 202 to Act 213) on the area B2 as an area to be printed next.

After the series of processing for the area B2 is completed, the CPU 2 selects the area A1 and the area B3 as processing targets. When both the print data on the front side and the print data on the rear side are set as processing targets in this way, in Act 203, the CPU 2 calculates, as the average number of print dots $D_{ave}$, a value obtained by adding up the average numbers of print dots in the area A1 and the area B3. Then, the CPU 2 performs the processing in Act 204 to Act 213 using the average number of print dots $D_{ave}$.

Thereafter, the CPU 2 sequentially selects the area A2 and the area B4, the area A3 and the area B5, the area A4 and the area B6, the area A5 and the area B7, the area A6, and the area A7 as processing targets and executes the series of processing (Act 202 to Act 213).

While the processing is executed with the respective areas set as targets, the energization time T and the conveying speed V are sequentially updated. Specifically, the energization time T and the conveying speed V finally set in the print-setting storing area 4*a* are values corresponding to maximums of the average numbers of print dots $D_{ave}$ in the areas divided in the processing in Act 201.

If the processing for all the areas is completed (No in Act 214), the CPU 2 determines whether the energization time T and the conveying speed V are changed in the processing (Act 215). If the energization time T and the conveying speed V are changed (Yes in Act 215), the CPU 2 outputs, to the display device 11 and the host apparatus 30, a warning indicating that the energization time T and the conveying speed V are changed (Act 216).

After outputting the warning or if the energization time T and the conveying speed V are not changed (No in Act 215), the CPU 2 ends the print setting adjustment processing. Then, the CPU 2 starts printing by the energization time T and the conveying speed V set in the print-setting storing area 4*a*.

As explained above, the thermal printer 1 according to this embodiment divides print data into a predetermined number of areas and counts the numbers of print dots in the areas. The thermal printer 1 adjusts to reduce, according to a maximum of an average of the numbers of print dots in the areas, one of the energization time T of energization to the heat generating elements and the conveying speed V of the print medium 22. If power consumption still exceeds the power supply capacity even if the one reaches the lower limit value in the adjustable range, the thermal printer 1 adjusts to reduce the other. In this way, even when print dots are concentrated in a part of print data, it is possible to set, with reference to the part, the energization time T and the conveying speed V such that the power consumption does not exceed the power supply capacity.

Besides the above, it goes without saying that effects same as those in the first embodiment are realized.

The present invention is not limited to the embodiments per se. In an implementation stage, the components can be modified and embodied as appropriate without departing from the gist of the present invention.

For example, in the embodiments, the present invention is applied to the thermal printer configured to perform printing on both the sides of a print medium. However, the present invention may be applied to a thermal printer that performs printing only on one side.

In the embodiments, the energization time T is set with reference to the set value table 3*b*. However, it is also possible to calculate the energization time T corresponding to the average number of print dots $D_{ave}$ using a predetermined calculation formula and set a calculation result in the print-setting storing area 4*a*.

In the embodiments, the energization time T and the conveying speed V are set on the basis of the print data or the average number of print dots $D_{ave}$ in the areas obtained by dividing the print data. However, the energization time T and the conveying speed V may be set on the basis of the print data or the numbers of print dots in the areas obtained by dividing the print data. In this case, effects same as those in the embodiments are realized if the set value table 3*b* and the like are corrected to a form corresponding to the numbers of print dots.

In the embodiments, the conveying speed V is adjusted in the two stages of V1 and V2. However, the conveying speed V may be adjusted in a large number of stages. In this case, the conveying speed V corresponding to the numbers of print dots or the average number of print dots only has to be specified by using a table same as the set value table 3*b* or a predetermined calculation formula. If the conveying speed V is adjusted in the large number of stages in this way, it is possible to realize print setting adapted to a more individual and specific state of use.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A thermal printer comprising:

a conveying unit configured to convey a print medium;

a thermal head configured to have linearly-disposed heat generating elements and control energization to the heat generating elements on the basis of print data to perform printing on the print medium conveyed by the conveying unit;

a print-dot counting section configured to count a number of print dots of the print data;

an adjusting section configured to adjust to reduce, according to the number of print dots counted by the print-dot counting section, one of conveying speed of the print medium by the conveying unit and energization time of energization to the heat generating elements for forming one dot on the print medium and adjust to reduce the other when the one reaches a lower limit value in an adjustable range; and a print control section configured to drive the conveying unit and the thermal head with the conveying speed and the energization time adjusted by the adjusting section and perform printing on the print medium.

2. The thermal printer according to claim 1, further comprising a priority designating section configured to designate one of the conveying speed and the energization time to be given priority to perform printing, wherein the adjusting section adjusts to reduce, according to the number of print dots counted by the print-dot counting section, one of the conveying speed and the energization time designated by the priority designating section and adjusts to reduce the other when the one reaches the lower limit value in the adjustable range.

3. The thermal printer according to claim 1, further comprising an adjustment-permission-or-rejection setting section configured to set permission or rejection of the adjustment concerning the energization time, wherein the adjusting section adjusts to reduce, when the adjustment-permission-or-rejection setting section sets permission of the adjustment of the energization time, the energization time according to the number of print dots counted by the print-dot counting section.

4. The thermal printer according to claim 1, further comprising an average calculating section configured to calculate an average per one line of the number of print dots counted by the print-dot counting section, wherein the adjusting section adjusts to reduce one of the conveying speed and the energization time according to the average calculated by the average calculating section and adjusts to reduce the other when the one reaches the lower limit value in the adjustable range.

5. The thermal printer according to claim 4, further comprising a threshold storing section having stored therein a threshold concerning the average per one line of the numbers of print dots, wherein the adjusting section adjusts to reduce, when the average calculated by the average calculating section is equal to or larger than the threshold stored in the threshold storing section, one of the conveying speed and the energization time according to the average and adjusts to reduce the other when the one reaches the lower limit in the adjustable range.

6. A thermal printer comprising:

a conveying unit configured to convey a print medium;

a thermal head configured to have linearly-disposed heat generating elements and control energization to the heat generating elements on the basis of print data to perform printing on the print medium conveyed by the conveying unit;

a print-dot counting section configured to divide the print data into a plurality of areas and count numbers of print dots of the areas;

an adjusting section configured to adjust to reduce, according to a maximum of the numbers of print dots in the areas counted by the print-dot counting section, one of conveying speed of the print medium by the conveying unit and energization time of energization to the heat generating elements for forming one dot on the print medium and adjust to reduce the other when the one reaches a lower limit value in an adjustable range; and a print control section configured to drive the conveying unit and the thermal head with the conveying speed and the energization time adjusted by the adjusting section and perform printing on the print medium.

7. The thermal printer according to claim 6, further comprising a priority designating section configured to designate one of the conveying speed and the energization time to be given priority to perform printing, wherein the adjusting section adjusts to reduce, according to the numbers of print dots in the areas counted by the print-dot counting section, one of the conveying speed and the energization time designated by the priority designating section and adjusts to reduce the other when the one reaches the lower limit value in the adjustable range.

8. The thermal printer according to claim 6, further comprising an adjustment-permission-or-rejection setting section configured to set permission or rejection of the adjustment concerning the energization time, wherein the adjusting section adjusts to reduce, when the adjustment-permission-or-rejection setting section sets permission of the adjustment of the energization time, the energization time according to the numbers of print dots in the areas counted by the print-dot counting section.

9. The thermal printer according to claim 6, further comprising an average calculating section configured to calculate an average per one line concerning the numbers of print dots in the areas counted by the print-dot counting section, wherein the adjusting section adjusts to reduce one of the conveying speed and the energization time according to the average of the numbers of print dots calculated by the average calculating section and adjusts to reduce the other when the one reaches the lower limit value in the adjustable range.

10. The thermal printer according to claim 9, further comprising a threshold storing section having stored therein a threshold concerning the average per one line of the numbers of print dots, wherein the adjusting section adjusts to reduce, when the average of the numbers of print dots in the areas calculated by the average calculating section is equal to or larger than the threshold stored in the threshold storing section, one of the conveying speed and the energization time according to the average and adjusts to reduce the other when the one reaches the lower limit in the adjustable range.

11. A thermal printer comprising:

a conveying unit configured to convey a print medium;

a first thermal head configured to have linearly-disposed heat generating elements and control energization to the heat generating elements on the basis of print data, which should be printed on one side of the print medium, to perform printing on the one side of the print medium conveyed by the conveying unit;

a second thermal head configured to have linearly-disposed heat generating elements and control energization to the heat generating elements on the basis of print data, which should be printed on the other side different from the one side of the print medium, to perform printing on the other side of the print medium conveyed by the conveying unit;

a print-dot counting section configured to count numbers of print dots of the print data on the one side and the other side;

an adjusting section configured to adjust to reduce, according to the numbers of print dots counted by the print-dot counting section, one of conveying speed of the print medium by the conveying unit and energization time of energization to the heat generating elements of the first thermal head and the second thermal head for forming one dot on the print medium and adjust to reduce the other when the one reaches a lower limit value in an adjustable range; and a print control section configured to drive the conveying unit and the first thermal head and the second thermal head with the conveying speed and the energization time adjusted by the adjusting section and perform printing on the print medium.

12. The thermal printer according to claim 11, further comprising a priority designating section configured to designate one of the conveying speed and the energization time to be given priority to perform printing, wherein the adjusting section adjusts to reduce, according to the number of print dots counted by the print-dot counting section, one of the conveying speed and the energization time designated by the priority designating section and adjusts to reduce the other when the one reaches the lower limit value in the adjustable range.

13. The thermal printer according to claim 11, further comprising an adjustment-permission-or-rejection setting section configured to set permission or rejection of the adjustment concerning each of the energization time of energization to the heat generating elements of the first thermal head and the energization time of energization to the heat generating element of the second thermal head, wherein the adjusting section adjusts to reduce, when the adjustment-permission-or-rejection setting section sets permission of the adjustment of the energization time, the energization time according to the number of print dots counted by the print-dot counting section.

14. The thermal printer according to claim 11, further comprising an adjustment-permission-or-rejection setting section configured to set permission or rejection of the adjustment concerning the energization time, wherein the adjusting section adjusts to reduce, when the adjustment-permission-or-rejection setting section sets permission of the adjustment of the energization time, the energization time according to the number of print dots counted by the print-dot counting section.

15. The thermal printer according to claim 11, further comprising an average calculating section configured to calculate an average per one line of numbers of print dots counted by the print-dot counting section, wherein the adjusting section adjusts to reduce one of the conveying speed and the energization time according to the average calculated by the average calculating section and adjusts to reduce the other when the one reaches the lower limit value in the adjustable range.

16. The thermal printer according to claim 15, further comprising a threshold storing section having stored therein a threshold concerning the average per one line of the numbers of print dots, wherein the adjusting section adjusts to reduce, when the average calculated by the average calculating section is equal to or larger than the threshold stored in the threshold storing section, one of the conveying speed and the energization time according to the average and adjusts to reduce the other when the one reaches the lower limit in the adjustable range.

* * * * *